US012016368B2

(12) United States Patent
Spencer et al.

(10) Patent No.: US 12,016,368 B2
(45) Date of Patent: Jun. 25, 2024

(54) PRODUCT INFUSED WITH SMOKE

(71) Applicant: NICOVENTURES TRADING LIMITED, London (GB)

(72) Inventors: Alfred Vincent Spencer, London (GB); Kelly Rees, London (GB); Connor Bruton, London (GB)

(73) Assignee: Nicoventures Trading Limited, London (GB)

( * ) Notice: Subject to any disclaimer, the term of this patent is extended or adjusted under 35 U.S.C. 154(b) by 601 days.

(21) Appl. No.: 16/639,287

(22) PCT Filed: Aug. 16, 2018

(86) PCT No.: PCT/GB2018/052332
§ 371 (c)(1),
(2) Date: Feb. 14, 2020

(87) PCT Pub. No.: WO2019/034884
PCT Pub. Date: Feb. 21, 2019

(65) Prior Publication Data

US 2020/0253265 A1 Aug. 13, 2020

(30) Foreign Application Priority Data

Aug. 17, 2017 (GB) ..... 1713203

(51) Int. Cl.
*A24B 15/167* (2020.01)
*A24B 15/24* (2006.01)
*A24B 15/30* (2006.01)
*A24B 15/32* (2006.01)

(52) U.S. Cl.
CPC ..... *A24B 15/167* (2016.11); *A24B 15/243* (2013.01); *A24B 15/303* (2013.01); *A24B 15/32* (2013.01)

(58) Field of Classification Search
CPC ..... A24F 40/10; A24F 40/42; A24B 15/167; A24B 15/243; A24B 15/303; A24B 15/32
See application file for complete search history.

(56) References Cited

U.S. PATENT DOCUMENTS

| | | | | |
|---|---|---|---|---|
| 4,945,928 | A * | 8/1990 | Rose | A24B 15/165 131/273 |
| 9,554,595 | B2 | 1/2017 | Buchberger | |
| 2009/0000632 | A1 | 1/2009 | Xue et al. | |
| 2012/0312314 | A1 | 12/2012 | Plakidis et al. | |
| 2015/0181928 | A1 | 7/2015 | Liu | |
| 2016/0143328 | A1 | 5/2016 | Griffiths et al. | |
| 2017/0000188 | A1 | 1/2017 | Nordskog et al. | |
| 2017/0065000 | A1 | 3/2017 | Sears et al. | |
| 2017/0079322 | A1 * | 3/2017 | Li | A24B 15/167 |
| 2017/0112190 | A1 | 4/2017 | Buchberger | |
| 2018/0289054 | A1 * | 10/2018 | Gerardi | A24B 3/12 |
| 2020/0253265 | A1 | 8/2020 | Spencer et al. | |

FOREIGN PATENT DOCUMENTS

| | | | | |
|---|---|---|---|---|
| CN | 102048238 | A | 5/2011 | |
| CN | 102421307 | A | 4/2012 | |
| CN | 203523812 | U | 4/2014 | |
| CN | 203610260 | | 5/2014 | |
| CN | 105011349 | A | 11/2014 | |
| CN | 103989244 | A | 11/2015 | |
| CN | 106572705 | A | 4/2017 | |
| GB | 359007 | A | 10/1931 | |
| JP | 2012525137 | A | 10/2012 | |
| JP | 2016526873 | A | 9/2016 | |
| JP | 2017515493 | A | 6/2017 | |
| LV | 14069 | B | 3/2010 | |
| WO | WO2015007742 | A | 1/2015 | |
| WO | WO-2015148649 | A2 * | 10/2015 | A24B 15/16 |
| WO | WO2015148649 | A2 | 10/2015 | |
| WO | WO-2015177252 | A1 | 11/2015 | |
| WO | WO-2015179388 | A1 | 11/2015 | |
| WO | 2016090303 | A1 | 6/2016 | |
| WO | WO2018033649 | A1 | 2/2018 | |
| WO | WO-2018033649 | A1 * | 2/2018 | |

OTHER PUBLICATIONS

International Search Report and Written Opinion for Application No. PCT/GB2018/052332, dated Oct. 10, 2018, 12 pages.
Office Action for Chinese Application No. 201880053081.8, dated Jan. 30, 2022, 20 pages.

(Continued)

*Primary Examiner* — Philip Y Louie
*Assistant Examiner* — Yana B Krinker
(74) *Attorney, Agent, or Firm* — WOMBLE BOND DICKINSON (US) LLP

(57) ABSTRACT

There is provided an aerosolizable product comprising an aerosol forming material, wherein the aerosol forming material is infused with smoke from tobacco. There is further provided an aerosolizable product comprising an aerosol forming material, wherein the aerosol forming material is selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof; and wherein the aerosol forming material is infused with smoke from a plant material.

24 Claims, No Drawings

(56) References Cited

OTHER PUBLICATIONS

Office Action for Korean Application No. 10-2020-7004178, dated Sep. 29, 2021, 19 pages.
Office Action dated Apr. 6, 2021 for Japanese Application No. 2020-503301, 12 pages.
International Preliminary Report on Patentability, Patent Application No. PCT/GB2018/052332, dated Feb. 27, 2020, 10 pages.
"General requirements for the competence of testing and calibraion laboratories," ISO 17025, Abstract.
"Tobacco and tobacco products—atmosphere for conditioning and testing," ISO 3402 (1999), Abstract.
"Routine analytical cigarette-smoking machine—definitions and standard conditions," ISO 3308: 12, Abstract.
Health Canada Test Method: "Determination of "Tar", Nicotine and Carbon Monoxide in Mainstream Tobacco Smoke," Health Canada—Official Method, T-115, Dec. 31, 1999, 6 pages.
Canadian Tobacco Reporting Regulations: Jul. 19, 2000 Canada Gazette part II, vol. 134, No. 15, part 3: Emissions from Designated Tobacco Products. Test method numbers refer to Health Canada methodologies which have been posted by Health Canada on the internet at site http://www.hc-sc.gc.ca/hl-vs/tobac-tabac/legislation/reg/indust/index_e.html.
"Cigarettes—Determination of Nicotine in Smoke Condensates—Gas-chromatographic method," ISO 10315, Abstract.
"Cigarettes—Determination of Water in Smoke Condensates—Part 1: Gas-chromatographic method," International Standard, ISO 10362-1, Second Edition, Dec. 12, 1999, 6 pages.
Gmeiner G, Stehlkik G, Tausch H, "Determination of Seventh Polycyclic Aromatic Hydrocarbons in Tobacco Smoke Condensate," Journal of Chromatography, 1997, A767, pp. 163-169.
Health Canada Test Method: "Determination of Selected Volatiles (1,3-Butadiene, Isoprene, Acrylonitrile, Benzene and Toluene) in Mainstream Tobacco Smoke," Health Canada—Official Method, T-116, Dec. 31, 1999, 9 pages.
Byrd G D, KW Fowler, R D Hicks, M E Lovette and M F Borgerding, "Isotope dilution gas chromatography-mass spectrometry in the determination of benzene, toluent, styrene and acrylonitrile in mainstream cigarette smoke," Journal of Chromatography, 503, pp. 359-368.
Brunnemann K D, M R Kagan, J E Cox and D Hoffmann (1990) "Analysis of 1,3-butadiene and other selected gas phase components in cigarette mainstream and sidestream smoke by gas chromatography-mass selective detection," Carcinogenesis, 1990, vol. 11 No. 10, pp. 1863-1868.
Brunnemann K D, M R Kagan, J E Cox and D Hoffmann (1989) Determination of benzene, toluene and 1,3-butadiene in cigarette smoke by GC-MSD, Exp Pathol, 11, pp. 108-113.
Wu W, Ashley D L., "Simultaneous Determination of Five Tobacco-Specific Nitrosamines in Mainstream Cigarette Smoke by Isotope Dilution Liquid Chromatography," Watson C H, Anal. Chem., 2003, vol. 75, pp. 4827-4832.
Wagner K A, Finkel N H, Fossett J E, Gillman I G, "Development of a Quantitative Method for the Analysis of Tobacco-Specific Nitrosamines in Mainstream Cigarette Smoke Using Isotope Dilution Liquid Chromatography/Electrospray Ionization Tandem Mass Spectrometry," Anal. Chem., 2005, vol. 77, pp. 1001-1006.
Lee J-M, Shin J-W, Oh I-H, Lee U-C, Rhee M-S, 2004 Coresta Congress Kyoto, Paper SS20, full text available on Coresta CD-ROM vol. 22, abstract available on the internet at http://coresta.org/Past_Abstracts/Kyoto2004-SmokeTech.pdf (accessed Dec. 29, 2006).
Chwojdak C A, Self D A, Wheeler H R, "A collaborative, harmonized LC/MS/MS Method for the Determination of Tobacco Specific Nitrosamines (TSNA) in Tobacco and Tobacco Related Materials," 61st Tobacco Science Research Conference, Charlotte, NC, USA, Sep. 24, 2007, 29 pages.
NIH Guidelines for the Laboratory Use of Chemical Carcinogens; NIH Publication 81-2385, 1981, 17 pages.
Wu J, Joza P, Sharifi M, Rickert W S, Lauterbach, "Quantitative Method for the Analysis of Tobacco-Specific Nitrosamines," J H, Anal. Chem. 2008, vol. 80, pp. 1341-1345.
Wu J and Rickert W B, "A New High Performance Liquid Chromatography—Fluorescence Detection Method for the Determination of Phenoloic Compounds in Cigaretter Smoke and Smokeless Tobacco Products", 63rd Tobacco Science Research Conference (TSRC), Sep. 27-30, 2009, Amelia Island, Florida USA, 1 page.
Risner C H and Cash S L, "A High Performance Liquid Chromatographic Determination of Major Phenolic Compounds in Tobacco Smoke", Journal of Chromatographic Science, May 1990, vol. 28, 7 pages.
Nanni E J, Lovetter M E, Hicks R D, Fowler K W and Borgerding M F, "Separation and quantitation of phenolic compounds in mainstream cigarette smoke by capillary gas chromatography with mass spectrometry in the selected ion mode", Journal of Chromatography, 1990, vol. 505, pp. 365-374.
Moldoveanu S C and Kiser M, "Gas chromatography/mass spectrometry versus liquid chromatography/fluorescence detection in the analysis of phenols in mainstream cigaretter smoke," Journal of Chromatography A, 2007, vol. 1141, pp. 90-97.
Health Canada Test Method: "Determination of Phenolic Compounds in Mainstream Tobacco Smoke" Health Canada—Official Method, T-114, Dec. 31, 1999, 11 pages.
Munch J W et al., "Determination of Carbonyl Compounds in Drinking Water by Pentafluorobenzylhydroxylamine Dervatization and Capillary Gas Chromatography with Electron Capture Detection," USA EPA Method 556, Jun. 1998, 37 pages.
Bao M L, Pantani F, Griffini O, Burrini D, Santianni D, Barbieri K, "Determination of Carbonyl Compounds in Water by Derivatization-Solid-Phase Microextraction and Gas Chromatographic Analysis," Journal of Chromatography. A., vol. 809, (1998), pp. 75-87.
Bao M L., Joza P J, Masters A, Rickert W S, "Analysis of Selected Carbonyl Compounds in Tobacco Samples by Using Pentafluorobenzylhydroxylamine Derivatization and Gas Chromatography-Mass Spectrometry," Beitrage zur Tabakforschung International., Sep. 2014, vol. 26 No. 3, pp. 86-97.
CORESTA Recommended method No. 56: Determination of Water in Tobacco and Tobacco Products by Karl Fischer Method.
"Tobacco and Tobacco Products—Determination of water content—Karl Fischer method," ISO 6488:2004(E), Abstract.
"Statistics—Vocabulary and symbols—Part 1: General statistical terms and terms used in probability" International Standard ISO 3534-1: 2006, Abstract.
"Standard Practice for Dealing with Outlying Observations," ASTM E178-08, Abstract.
Liu, Youxon (editor), Basic Chemistry for Tests, People's Military Medical Press, Apr. 2012, 4 pages, 1st edition, China.
Tobacco Reporting Regulations, Jul. 19, 2000, 7 pages, Canada Gazette Part II, vol. 134, No. 15, Schedules 1-3, Ottawa, Canada.

* cited by examiner

PRODUCT INFUSED WITH SMOKE

PRIORITY CLAIM

The present application is a National Phase entry of PCT Application No. PCT/GB2018/052332, filed Aug. 16, 2018, which claims priority from GB Patent Application No. 1713203.6, filed Aug. 17, 2017, each of which is hereby fully incorporated herein by reference.

TECHNICAL FIELD

The present disclosure relates to an aerosolizable product, containers in which are contained the aerosolizable product and to electronic vapor provision systems such as electronic delivery systems (e.g. e-cigarettes) incorporating said aerosolizable product.

BACKGROUND

Electronic vapor provision systems such as e-cigarettes generally contain a reservoir of liquid which is to be vaporized, typically containing nicotine. When a user inhales on the device, a heater is activated to vaporize a small amount of liquid, which is therefore inhaled by the user.

The use of e-cigarettes in the UK has grown rapidly, and it has been estimated that there are now almost three million people using them in the UK.

One challenge faced in providing such systems is to provide from the vapor provision device a vapor to be inhaled which provides consumers with an acceptable experience. Some consumers may prefer an e-cigarette that generates an aerosol that closely 'mimics' smoke inhaled from a tobacco product such as a cigarette. Aerosols from e-cigarettes and smoke from tobacco products such as cigarettes provides to the user a complex chain of flavor in the mouth. These various aspects are described by users in terms of flavor, intensity/quality, impact, and irritation/smoothness. Each of these factors, and their balance, can strongly contribute to consumer acceptability of an e-cigarette. Providing ways to improve the overall vaping experience is therefore desirable to e-cigarette manufacturers. To address these requirements, most 'e-liquids' are imparted with flavor/aroma by adding in specific flavorants to the e-liquid. However, it is still considered that these substrates could be improved in terms of the flavor/aroma they provide.

SUMMARY

In one aspect there is provided an aerosolizable product comprising an aerosol forming material, wherein the aerosol forming material is infused with smoke from tobacco.

In one aspect there is provided an aerosolizable product comprising an aerosol forming material, wherein the aerosol forming material is selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof [preferably wherein the aerosol forming material is selected from glycerol, propylene glycol, and mixtures thereof]; and wherein the aerosol forming material is infused with smoke from a plant material.

The aerosol generating product preferably comprises aerosol forming material, and may be for example polyhydric alcohols, such as glycerol, propylene glycol and triethylene glycol, for example, or esters such as triethyl citrate or triacetin, or high boiling point hydrocarbons, or non-polyols, such as glycols, sorbitol or lactic acid, for example.

In one aspect there is provided a contained aerosolizable product comprising (a) a container; and (b) an aerosolizable product comprising an aerosol forming material, wherein the aerosol forming material is infused with smoke from tobacco.

In one aspect there is provided a contained aerosolizable product comprising (a) a container; and (b) aerosolizable product comprising an aerosol forming material, wherein the aerosol forming material is selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof [preferably wherein the aerosol forming material is selected from glycerol, propylene glycol, and mixtures thereof]; and wherein the aerosol forming material is infused with smoke from a plant material.

In one aspect there is provided an electronic aerosol provision system comprising:

(i) an aerosolizer for aerosolizing an aerosolizable product for inhalation by a user of the electronic aerosol provision system;

(ii) a power supply comprising a cell or battery for supplying power to the aerosolizer; and (iii) an aerosolizable product comprising an aerosol forming material, wherein the aerosol forming material is infused with smoke from tobacco.

In one aspect there is provided an electronic aerosol provision system comprising:

(i) an aerosolizer for aerosolizing an aerosolizable product for inhalation by a user of the electronic aerosol provision system;

(ii) a power supply comprising a cell or battery for supplying power to the aerosolizer; and (iii) aerosolizable product comprising an aerosol forming material, wherein the aerosol forming material is selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof [preferably wherein the aerosol forming material is selected from glycerol, propylene glycol, and mixtures thereof]; and wherein the aerosol forming material is infused with smoke from a plant material.

In one aspect there is provided a process for improving the sensory properties of aerosolizable product, the process comprising:

(a) providing an aerosol forming material, (b) infusing the aerosol forming material with smoke from tobacco.

In one aspect there is provided a process for improving the sensory properties of aerosolizable product, the process comprising:

(a) providing an aerosol forming material selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof [preferably wherein the aerosol forming material is selected from glycerol, propylene glycol, and mixtures thereof]; and, (b) infusing the aerosol forming material with smoke from a plant material.

In one aspect there is provided use of smoke for improving sensory properties of an aerosol forming material.

The above summary is not intended to describe each illustrated embodiment or every implementation of the subject matter hereof. The detailed description that follows more particularly exemplifies various embodiments.

DETAILED DESCRIPTION

As discussed herein the present disclosure provides an aerosolizable product comprising an aerosol forming material, wherein the aerosol forming material is infused with smoke from tobacco, and the present disclosure provides an aerosolizable product comprising an aerosol forming material, wherein the aerosol forming material is selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof [preferably wherein the aerosol forming material is selected from glycerol, propylene glycol, and mixtures thereof]; and wherein the aerosol forming material is infused with smoke from a plant material.

We have found the flavor and/or aroma provided by an aerosol forming material in an aerosolizable product may be enhanced by subjecting the aerosol forming material, such as glycerol, to smoke from a plant material, and in particular smoke from tobacco. Various combinations of plant material may be used to generate the smoke, such as tobacco only, combinations of tobacco and wood, and wood only. The generated smoke is then contacted with the aerosol forming material, such as glycerol.

For ease of reference, these and further aspects of the present disclosure are now discussed under appropriate section headings. However, the teachings under each section are not necessarily limited to each particular section.

Aerosol Forming Material

As discussed herein, when the aerosol forming material is infused with smoke from tobacco the aerosol forming material may be any suitable material. As discussed herein, the aerosolizable product comprises an aerosol forming material. As will be appreciated by one skilled in the art, that the aerosolizable product comprises an aerosol forming material means that the aerosolizable product contains at least one aerosol forming material. References herein to an aerosol forming material may be read to relate to at least one aerosol forming material.

The aerosol forming material may be selected from water, polyhydric alcohols, such as glycerol, propylene glycol and triethylene glycol, for example, or esters such as triethyl citrate or triacetin, or high boiling point hydrocarbons, or non-polyols, such as glycols, sorbitol or lactic acid, for example. The aerosol forming material may be selected from polyhydric alcohols, such as glycerol, propylene glycol and triethylene glycol, for example, or esters such as triethyl citrate or triacetin, or high boiling point hydrocarbons, or non-polyols, such as glycols, sorbitol or lactic acid, for example. In one aspect, the aerosol forming material is selected from polyhydric alcohols (such as glycerol, propylene glycol and triethylene glycol), esters (such as triethyl citrate and triacetin), high boiling point hydrocarbons, non-polyols (such as glycols, sorbitol and lactic acid), and mixtures thereof [preferably wherein the aerosol forming material is selected from glycerol, propylene glycol, and mixtures thereof].

The aerosol forming material may be selected from water, triethylene glycol, triethyl citrate, triacetin, glycols, sorbitol, lactic acid, glycerol, propylene glycol, and mixtures thereof. The aerosol forming material may be selected from triethylene glycol, triethyl citrate, triacetin, glycols, sorbitol, lactic acid, glycerol, propylene glycol, and mixtures thereof.

In one aspect, the aerosol forming material is selected from water, glycerol, propylene glycol, and mixtures thereof. In one aspect, the aerosol forming material is selected from glycerol, propylene glycol, and mixtures thereof.

In one aspect the aerosol forming material is at least water. In this aspect, a further aerosol forming material may be present or may not be present. In a further aspect, the aerosol forming material comprises water and at least one aerosol forming material other than water. In one aspect, the one or more aerosol forming materials is mixture of (a) water and (b) glycerol, propylene glycol or a mixture thereof.

The aerosol forming material may be provided in any suitable physical form. In one aspect, the aerosol forming material is the form of a gel, liquid or paste. In one aspect, the aerosol forming material is the form of a liquid.

The one or more aerosol forming materials may be present in any suitable amount in the aerosolizable product. In one aspect the one or more aerosol forming materials is present in a total amount of at least 5 wt. % based on the aerosolizable product. In one aspect the one or more aerosol forming materials is present in a total amount of at least 10 wt. % based on the aerosolizable product. In one aspect the one or more aerosol forming materials is present in a total amount of at least 15 wt. % based on the aerosolizable product. In one aspect the one or more aerosol forming materials is present in a total amount of at least 20 wt. % based on the aerosolizable product. In one aspect the one or more aerosol forming materials is present in a total amount of at least 25 wt. % based on the aerosolizable product. In one aspect the one or more aerosol forming materials is present in a total amount of at least 30 wt. % based on the aerosolizable product. In one aspect the one or more aerosol forming materials is present in a total amount of at least 35 wt. % based on the aerosolizable product. In one aspect the one or more aerosol forming materials is present in a total amount of at least 40 wt. % based on the aerosolizable product. In one aspect the one or more aerosol forming materials is present in a total amount of at least 45 wt. % based on the aerosolizable product. In one aspect the one or more aerosol forming materials is present in a total amount of at least 50 wt. % based on the aerosolizable product. In one aspect the one or more aerosol forming materials is present in a total amount of at least 55 wt. % based on the aerosolizable product. In one aspect the one or more aerosol forming materials is present in a total amount of at least 60 wt. % based on the aerosolizable product. In one aspect the one or more aerosol forming materials is present in a total amount of at least 65 wt. % based on the aerosolizable product. In one aspect the one or more aerosol forming materials is present in a total amount of at least 70 wt. % based on the aerosolizable product. In one aspect the one or more aerosol forming materials is present in a total amount of at least 75 wt. % based on the aerosolizable product. In one aspect the one or more aerosol forming materials is present in a total amount of at least 80 wt. % based on the aerosolizable product. In one aspect the one or more aerosol forming materials is present in a total amount of at least 85 wt. % based on the aerosolizable product. In one aspect the one or more aerosol forming materials is present in a total amount of at least 90 wt. % based on the aerosolizable product.

In one aspect the one or more aerosol forming materials is present in a total amount of from 5 to 99 wt. % based on the aerosolizable product. In one aspect the one or more aerosol forming materials is present in a total amount of from 10 to 99 wt. % based on the aerosolizable product. In one aspect the one or more aerosol forming materials is present in a total amount of from 15 to 99 wt. % based on the aerosolizable product. In one aspect the one or more aerosol forming materials is present in a total amount of from 20 to 99 wt. % based on the aerosolizable product. In one aspect the one or more aerosol forming materials is present in a total amount of from 25 to 99 wt. % based on the aerosolizable product. In one aspect the one or more aerosol forming materials is present in a total amount of from 30 to 99 wt. % based on the aerosolizable product. In one aspect the one or more aerosol forming materials is present in a total amount of from 35 to 99 wt. % based on the aerosolizable product. In one aspect the one or more aerosol forming materials is present in a total amount of from 40 to 99 wt. % based on the aerosolizable product. In one aspect the one or more aerosol forming materials is present in a total amount of from 45 to 99 wt. % based on the aerosolizable product. In one aspect the one or more aerosol forming materials is present in a total amount of from 50 to 99 wt. % based on the aerosolizable product. In one aspect the one or more aerosol forming materials is present in a total amount of from 55 to 99 wt. % based on the aerosolizable product. In one aspect the one or more aerosol forming materials is present in a total amount of from 60 to 99 wt. % based on the aerosolizable product. In one aspect the one or more aerosol forming materials is present in a total amount of from 65 to 99 wt. % based on the aerosolizable product. In one aspect the one or more aerosol forming materials is present in a total amount of from 70 to 99 wt. % based on the aerosolizable product. In one aspect the one or more aerosol forming materials is present in a total amount of from 75 to 99 wt. % based on the aerosolizable product. In one aspect the one or more aerosol forming materials is present in a total amount of from 80 to 99 wt. % based on the aerosolizable product. In one aspect the one or more aerosol forming materials is present in a total amount of from 85 to 99 wt. % based on the aerosolizable product. In one aspect the one or more aerosol forming materials is present in a total amount of from 90 to 99 wt. % based on the aerosolizable product.

In one aspect the one or more aerosol forming materials is present in a total amount of from 5 to 95 wt. % based on the aerosolizable product. In one aspect the one or more aerosol forming materials is present in a total amount of from 10 to 95 wt. % based on the aerosolizable product. In one aspect the one or more aerosol forming materials is present in a total amount of from 15 to 95 wt. % based on the aerosolizable product. In one aspect the one or more aerosol forming materials is present in a total amount of from 20 to 95 wt. % based on the aerosolizable product. In one aspect the one or more aerosol forming materials is present in a total amount of from 25 to 95 wt. % based on the aerosolizable product. In one aspect the one or more aerosol forming materials is present in a total amount of from 30 to 95 wt. % based on the aerosolizable product. In one aspect the one or more aerosol forming materials is present in a total amount of from 35 to 95 wt. % based on the aerosolizable product. In one aspect the one or more aerosol forming materials is present in a total amount of from 40 to 95 wt. % based on the aerosolizable product. In one aspect the one or more aerosol forming materials is present in a total amount of from 45 to 95 wt. % based on the aerosolizable product. In one aspect the one or more aerosol forming materials is present in a total amount of from 50 to 95 wt. % based on the aerosolizable product. In one aspect the one or more aerosol forming materials is present in a total amount of from 55 to 95 wt. % based on the aerosolizable product. In one aspect the one or more aerosol forming materials is present in a total amount of from 60 to 95 wt. % based on the aerosolizable product. In one aspect the one or more aerosol forming materials is present in a total amount of from 65 to 95 wt. % based on the aerosolizable product. In one aspect the one or more aerosol forming materials is present in a total amount of from 70 to 95 wt. % based on the aerosolizable product. In one aspect the one or more aerosol forming materials is present in a total amount of from 75 to 95 wt. % based on the aerosolizable product. In one aspect the one or more aerosol forming materials is present in a total amount of from 80 to 95 wt. % based on the aerosolizable product. In one aspect the one or more aerosol forming materials is present in a total amount of from 85 to 95 wt. % based on the aerosolizable product. In one aspect the one or more aerosol forming materials is present in a total amount of from 90 to 95 wt. % based on the aerosolizable product.

As discussed herein, in one aspect the aerosol forming material is at least water. The water may be present in any suitable amount in the aerosolizable product. In one aspect the water is present in a total amount of at least 5 wt. % based on the aerosolizable product. In one aspect the water is present in a total amount of at least 10 wt. % based on the aerosolizable product. In one aspect the water is present in a total amount of at least 15 wt. % based on the aerosolizable product. In one aspect the water is present in a total amount of at least 20 wt. % based on the aerosolizable product. In one aspect the water is present in a total amount of at least 25 wt. % based on the aerosolizable product.

In one aspect the water is present in a total amount of from 5 to 30 wt. % based on the aerosolizable product. In one aspect the water is present in a total amount of from 10 to 30 wt. % based on the aerosolizable product. In one aspect the water is present in a total amount of from 15 to 30 wt. % based on the aerosolizable product. In one aspect the water is present in a total amount of from 20 to 30 wt. % based on the aerosolizable product. In one aspect the water is present in a total amount of from 25 to 30 wt. % based on the aerosolizable product.

As discussed herein, in one aspect the aerosol forming material is at least glycerol. The glycerol may be present in any suitable amount in the aerosolizable product. In one aspect the glycerol is present in a total amount of at least 5 wt. % based on the aerosolizable product. In one aspect the glycerol is present in a total amount of at least 10 wt. % based on the aerosolizable product. In one aspect the glycerol is present in a total amount of at least 15 wt. % based on the aerosolizable product. In one aspect the glycerol is present in a total amount of at least 20 wt. % based on the aerosolizable product. In one aspect the glycerol is present in a total amount of at least 25 wt. % based on the aerosolizable product. In one aspect the glycerol is present in a total amount of at least 30 wt. % based on the aerosolizable product. In one aspect the glycerol is present in a total amount of at least 35 wt. % based on the aerosolizable product.

In one aspect the glycerol is present in a total amount of from 5 to 40 wt. % based on the aerosolizable product. In one aspect the glycerol is present in a total amount of from 10 to 40 wt. % based on the aerosolizable product. In one aspect the glycerol is present in a total amount of from 15 to 40 wt. % based on the aerosolizable product. In one aspect the glycerol is present in a total amount of from 20 to 40 wt. % based on the aerosolizable product. In one aspect the glycerol is present in a total amount of from 25 to 40 wt. % based on the aerosolizable product. In one aspect the glycerol is present in a total amount of from 30 to 40 wt. % based on the aerosolizable product. In one aspect the glycerol is present in a total amount of from 35 to 40 wt. % based on the aerosolizable product.

As discussed herein, in one aspect the aerosol forming material is at least propylene glycol. The propylene glycol may be present in any suitable amount in the aerosolizable product. In one aspect the propylene glycol is present in a total amount of at least 5 wt. % based on the aerosolizable product. In one aspect the propylene glycol is present in a total amount of at least 10 wt. % based on the aerosolizable product. In one aspect the propylene glycol is present in a total amount of at least 15 wt. % based on the aerosolizable product. In one aspect the propylene glycol is present in a total amount of at least 20 wt. % based on the aerosolizable product. In one aspect the propylene glycol is present in a total amount of at least 25 wt. % based on the aerosolizable product. In one aspect the propylene glycol is present in a total amount of at least 30 wt. % based on the aerosolizable product. In one aspect the propylene glycol is present in a total amount of at least 35 wt. % based on the aerosolizable product.

In one aspect the propylene glycol is present in a total amount of from 5 to 40 wt. % based on the aerosolizable product. In one aspect the propylene glycol is present in a total amount of from 10 to 40 wt. % based on the aerosolizable product. In one aspect the propylene glycol is present in a total amount of from 15 to 40 wt. % based on the aerosolizable product. In one aspect the propylene glycol is present in a total amount of from 20 to 40 wt. % based on the aerosolizable product. In one aspect the propylene glycol is present in a total amount of from 25 to 40 wt. % based on the aerosolizable product. In one aspect the propylene glycol is present in a total amount of from 30 to 40 wt. % based on the aerosolizable product. In one aspect the propylene glycol is present in a total amount of from 35 to 40 wt. % based on the aerosolizable product.

Smoke

As discussed herein, the aerosol forming material is infused with smoke from a plant material.

In one aspect the plant material is selected from tobacco, wood, botanicals, *cannabis*, and combinations thereof.

In one aspect the plant material is selected from tobacco, wood, and combinations thereof.

In one aspect the plant material is at least wood. In one aspect the plant material is only wood.

In one aspect the plant material is at least tobacco. In one aspect the plant material is only tobacco.

In one aspect the plant material is at least tobacco and wood. In one aspect the plant material is only tobacco and wood.

In one aspect the wood is selected from oak wood, cherry wood, hickory wood, beech wood, and combinations thereof.

The aerosol forming material may be infused with smoke from one plant material or with smoke from more than one plant material. If the aerosol forming material is infused with smoke from more than one plant material then the infusion may be performed in series or the infusion may be performed by combining the smoke and infusing the combined smoke with the aerosol forming material.

In one aspect, the aerosol forming material is infused with smoke from tobacco and is infused with smoke from wood. In one aspect the aerosol forming material is infused with smoke from tobacco and is infused with smoke from cherry wood. In one aspect the aerosol forming material is infused with smoke from tobacco and is infused with smoke from oak wood.

In one aspect, the smoke is infused with smoke in accordance with a method as described in WO2015/007742.

Prior to the infusion of the aerosol forming material with smoke, the smoke may be treated between its formation and the infusion. However, in one aspect in may remain untreated between formation of the smoke and infusion. If the smoke is treated, this may be to remove undesirable components. In one aspect, the smoke is treated to selectively remove toxicants. In one aspect, the aerosol forming material is infused with smoke treated to selectively remove toxicants therefrom. In one aspect, the aerosol forming material is infused with smoke treated to selectively remove therefrom one or more aromatic hydrocarbons. In one aspect, the aerosol forming material is infused with smoke treated to selectively remove therefrom benzene or a derivative thereof. In one aspect, the aerosol forming material is infused with smoke treated to selectively remove toluene. In one aspect, the aerosol forming material is infused with smoke treated to selectively remove phenol. In one aspect, the aerosol forming material is infused with smoke treated to selectively remove therefrom one or more polycyclic aromatic hydrocarbons that contain 4 or more benzene rings. In one aspect, the aerosol forming material is infused with smoke treated to selectively remove benzo(a)pyrene therefrom. In one aspect, the aerosol forming material is infused with smoke treated to selectively remove one or more toxicant selected from toluene, phenol and polycyclic aromatic hydrocarbons that contain 4 or more benzene rings. In one aspect, the aerosol forming material is infused with smoke treated to selectively remove one or more toxicant selected from toluene, phenol and benzo(a)pyrene. In one aspect, the aerosol forming material is infused with smoke treated to selectively remove toluene and benzo(a)pyrene therefrom. In one aspect, the aerosol forming material is infused with smoke treated to selectively remove toluene, phenol and polycyclic aromatic hydrocarbons that contain 4 or more benzene rings. In one aspect, the aerosol forming material is infused with smoke treated to selectively remove toluene, phenol and benzo(a)pyrene.

In one aspect, the smoke may be treated in accordance with a method as described in WO2015/007742.

Aerosolizable Product

The aerosolizable product may contain one or more further components. These components may be selected depending on the nature of the formulation. In one aspect, the aerosolizable product further comprises an active agent. By "active agent" it is meant an agent which has a biological effect on a subject when the vapor is inhaled. The one or more active agents may be selected from nicotine, botanicals, cannabinoids, and mixtures thereof.

In one aspect, the active agent is at least nicotine. Nicotine may be provided at any suitable amount depending on the desired dosage to be inhaled by the user. In one aspect nicotine is present in an amount of no greater than 6 wt % based on the total weight of the aerosolizable product. In one aspect nicotine is present in an amount of from 0.4 to 6 wt % based on the total weight of the aerosolizable product. In one aspect nicotine is present in an amount of from 0.8 to 6 wt % based on the total weight of the aerosolizable product. In one aspect nicotine is present in an amount of from 1 to 6 wt % based on the total weight of the aerosolizable product. In one aspect nicotine is present in an amount of from 1.8 to 6 wt % based on the total weight of the aerosolizable product. In one aspect nicotine is present in an amount of from 0.4 to 5 wt % based on the total weight of the aerosolizable product. In one aspect nicotine is present in an amount of from 0.8 to 5 wt % based on the total weight of the aerosolizable product. In one aspect nicotine is present in an amount of from 1 to 5 wt % based on the total weight of the aerosolizable product. In one aspect nicotine is present in an amount of from 1.8 to 5 wt % based on the total weight of the aerosolizable product. In one aspect nicotine is present in an amount of no greater than 4 wt % based on the total weight of the aerosolizable product. In one aspect nicotine is present in an amount of from 0.4 to 4 wt % based on the total weight of the aerosolizable product. In one aspect nicotine is present in an amount of from 0.8 to 4 wt % based on the total weight of the aerosolizable product. In one aspect nicotine is present in an amount of from 1 to 4 wt % based on the total weight of the aerosolizable product. In one aspect nicotine is present in an amount of from 1.8 to 4 wt % based on the total weight of the aerosolizable product. In one aspect nicotine is present in an amount of no greater than 3 wt % based on the total weight of the aerosolizable product. In one aspect nicotine is present in an amount of from 0.4 to 3 wt % based on the total weight of the aerosolizable product. In one aspect nicotine is present in an amount of from 0.8 to 3 wt % based on the total weight of the aerosolizable product. In one aspect nicotine is present in an amount of from 1 to 3 wt % based on the total weight of the aerosolizable product. In one aspect nicotine is present in an amount of from 1.8 to 3 wt % based on the total weight of the aerosolizable product. In one aspect nicotine is present in an amount of no greater than 1.9 wt % based on the total weight of the aerosolizable product. In one aspect nicotine is present in an amount of no greater than 1.8 wt % based on the total weight of the aerosolizable product. In one aspect nicotine is present in an amount of from 0.4 to 1.9 wt % based on the total weight of the aerosolizable product. In one aspect nicotine is present in an amount of from 0.4 to 1.8 wt % based on the total weight of the aerosolizable product. In one aspect nicotine is present in an amount of from 0.5 to 1.9 wt % based on the total weight of the aerosolizable product. In one aspect nicotine is present in an amount of from 0.5 to 1.8 wt % based on the total weight of the aerosolizable product. In one aspect nicotine is present in an amount of from 0.8 to 1.9 wt % based on the total weight of the aerosolizable product. In one aspect nicotine is present in an amount of from 0.8 to 1.8 wt % based on the total weight of the aerosolizable product. In one aspect nicotine is present in an amount of from 1 to 1.9 wt % based on the total weight of the aerosolizable product. In one aspect nicotine is present in an amount of from 1 to 1.8 wt % based on the total weight of the aerosolizable product. In one aspect nicotine is present in an amount of less than 1.9 wt % based on the total weight of the aerosolizable product. In one aspect nicotine is present in an amount of less than 1.8 wt % based on the total weight of the aerosolizable product. In one aspect nicotine is present in an amount of from 0.4 to less than 1.9 wt % based on the total weight of the aerosolizable product. In one aspect nicotine is present in an amount of from 0.4 to less than 1.8 wt % based on the total weight of the aerosolizable product. In one aspect nicotine is present in an amount of from 0.5 to less than 1.9 wt % based on the total weight of the aerosolizable product. In one aspect nicotine is present in an amount of from 0.5 to less than 1.8 wt % based on the total weight of the aerosolizable product. In one aspect nicotine is present in an amount of from 0.8 to less than 1.9 wt % based on the total weight of the aerosolizable product. In one aspect nicotine is present in an amount of from 0.8 to less than 1.8 wt % based on the total weight of the aerosolizable product. In one aspect nicotine is present in an amount of from 1 to less than 1.9 wt % based on the total weight of the aerosolizable product. In one aspect nicotine is present in an amount of from 1 to less than 1.8 wt % based on the total weight of the aerosolizable product.

The aerosol is formed from the aerosolizable product may have a pH of from 3.5 to 7.5.

Process

The present disclosure further provides a process for forming a vapor, the process comprising (a) providing an aerosolizable product comprising an aerosol forming material, wherein the aerosol forming material is infused with smoke from tobacco; and (b) vaporizing the aerosolizable product.

The present disclosure further provides a process for forming a vapor, the process comprising (a) providing an aerosolizable product comprising an aerosol forming material, wherein the aerosol forming material is selected from glycerol, propylene glycol, and mixtures thereof; and wherein the aerosol forming material is infused with smoke from a plant material; and (b) vaporizing the aerosolizable product.

The present disclosure further provides a process for improving the sensory properties of aerosolizable product, the process comprising:

(a) providing an aerosol forming material, (b) infusing the aerosol forming material with smoke from tobacco.

The present disclosure further provides a process for improving the sensory properties of aerosolizable product, the process comprising:

(a) providing an aerosol forming material selected from glycerol, propylene glycol, and mixtures thereof; and, (b) infusing the aerosol forming material with smoke from a plant material.

EXAMPLES

Formulation

To prepare a flavored liquid 500 g of tobacco (Virginia) was smoldered alongside 500 g of a selected wood (oak) for a total of 4 hours. The created smoke was then separated into two samples. One sample was filtered in accordance with a method as described in WO2015/007742 and the other sample was not filtered. The smoke samples were then exposed to the selected aerosolizable material (propylene glycol).

Sample A was the sample treated in accordance with WO2015/007742. Sample B was the sample that was not passed through the filtration process before being exposed to the aerosolizable material (propylene glycol).

Sample Analysis

A series of analytical tests were required in order to quantify key compounds. The liquids were tested in respect of nicotine, water, glycerol, N-Nitrosonornicotine (NNN), N'-nitrosoanatabine (NAT), N-nitrosoanabasine (NAB), nicotine-derived nitrosamine ketone (NNK—also known as 4-(methylnitrosamino)-1-(3-pyridyl)-1-butanone), benzo(a)

pyrene, toluene, phenol and propylene glycol. The aerosols were tested in respect of formaldehyde, acetaldehyde, acetone, propionaldehyde, isobutyraldehyde, methyl ethyl ketone, acetol, glyoxal, methylglyoxal, 2,3-butanedione, acrolein, n-butyraldehyde, crotonaldehyde, glycolaldehyde, acetoin, 2,3-pentanedione, 2,3-hexanedione, and 2,3-heptanedione.

For emission testing a Vype e-Tank device was filled using the following formulation matrix. The presence and levels of the carbonyls listed above 1 were tested for.

| | |
|---|---|
| vegetable glycerol | 47% w/w |
| propylene glycol (smoke treated) | 35% w/w |
| water | 18% w/w |

Devices containing samples A & B were then puffed on a linear smoke machine using a 80/3/30 regime. A total of 100 puffs were captured for both samples in 25 puff blocks. 3 reps per puff block were measured with an average obtained.

Liquid Testing

The below analytes were not detected within the liquid of either sample (A or B):

Nicotine, glycerol, NNN, NAT, NAB, and NNK.

It was also noted that

Sample A—benzo(a)pyrene (<LOD) vs sample B

Sample A—toluene (<LOD) vs sample B

Sample A—phenol levels significantly lower vs sample B

Aerosol Testing

The below analytes were not detected within the aerosol formed from either sample (A or B): acrolein, n-butyraldehyde, crotonaldehyde, glycolaldehyde, acetoin, 2,3-pentanedione, 2,3-hexanedione, and 2,3-heptanedione.

User Testing

When each of Samples A and B are tested by a user panel they are found to provide a pleasant experience. Each of Samples A and B are found to provide an aerosol have flavor and aroma which is enhanced compared to a non-smoked product.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. An aerosolizable product comprising an aerosol forming material, wherein the aerosol forming material is infused with smoke from tobacco, where the aerosol forming material is infused with smoke treated to selectively remove therefrom one or more aromatic hydrocarbons;

wherein the aerosol forming material is selected from polyhydric alcohols, esters, high boiling point hydrocarbons, non-polyols, and mixtures thereof.

2. The aerosolizable product according to claim 1, further comprising nicotine.

3. The aerosolizable product according to claim 2 comprising nicotine in an amount of no greater than 2 wt ¾ based on the total weight of the aerosolizable product.

4. The aerosolizable product according to claim 2 comprising nicotine in an amount of no greater than 1.8 wt ¾ based on the total weight of the aerosolizable product.

5. The aerosolizable product according to claim 1 further comprising water.

6. The aerosolizable product according to claim 1 wherein the aerosol forming material is infused with smoke from tobacco and is infused with smoke from wood.

7. The aerosolizable product according to claim 6 wherein the aerosol forming material is infused with smoke from tobacco and is infused with smoke from cherry wood.

8. The aerosolizable product according to claim 6 wherein the aerosol forming material is infused with smoke from tobacco and is infused with smoke from oak wood.

9. The aerosolizable product according to claim 1 wherein the aerosol forming material is infused with smoke treated to selectively remove therefrom benzene or a derivative thereof.

10. The aerosolizable product according to claim 9 wherein the aerosol forming material is infused with smoke treated to selectively remove toluene.

11. The aerosolizable product according to claim 1 wherein the aerosol forming material is infused with smoke treated to selectively remove therefrom one or more polycyclic aromatic hydrocarbons that contain 4 or more benzene rings.

12. The aerosolizable product according to claim 11 wherein the aerosol forming material is infused with smoke treated to selectively remove benzo(a)pyrene therefrom.

13. The aerosolizable product according to claim 1 wherein the aerosol forming material is infused with smoke treated to selectively remove toluene and benzo(a)pyrene therefrom.

14. The aerosolizable product according to claim 1 wherein the aerosol has a pH of from 3.5 to 7.5.

15. The aerosolizable product according to claim 1 wherein the aerosol forming material is selected from glycerol, propylene glycol and mixtures thereof.

16. The aerosolizable product according to claim 1 wherein the aerosol forming material is present in an amount of at least 50 wt ¾ based on the total weight of the aerosolizable product.

17. A contained aerosolizable product comprising:

(a) a container; and (b) an aerosolizable product as defined in claim 1.

18. The contained aerosolizable product according to claim 17 wherein the container is configured for engagement with an electronic aerosol provision system.

19. An electronic aerosol provision system comprising:

(i) an aerosolizer for aerosolizing an aerosolizable product for inhalation by a user of the electronic aerosol provision system;

(ii) a power supply comprising a cell or battery for supplying power to the aerosoliser; and (iii) an aerosolizable product as defined in claim 1.

20. An aerosolizable product comprising an aerosol forming material, wherein the aerosol forming material is selected from polyhydric alcohols, esters, high boiling point hydrocarbons, non-polyols, and mixtures thereof;

wherein the aerosol forming material is infused with smoke from a plant material; and wherein the aerosol forming material is infused with smoke treated to selectively remove therefrom one or more aromatic hydrocarbons.

21. The aerosolizable product according to claim 20 wherein the plant material is selected from the group consisting of: wood, botanicals, *cannabis*, and combinations thereof.

22. The aerosolizable product according to claim 21 wherein the wood is selected from the group consisting of: oak wood, cherry wood, hickory wood, beech wood, and combinations thereof.

23. A process for improving the sensory properties of an aerosolizable product, the process comprising the steps of:

(a) providing an aerosol forming material selected from polyhydric alcohols, esters, high boiling point hydrocarbons, non-polyols, and mixtures thereof, (b) infusing the aerosol forming material with smoke from tobacco, wherein the smoke is treated to selectively remove therefrom one or more aromatic hydrocarbons.

24. A process for improving the sensory properties of an aerosolizable product, the process comprising the steps of (a) providing an aerosol forming material selected from polyhydric alcohols, esters, high boiling point hydrocarbons, non-polyols, and mixtures thereof; and, (b) infusing the aerosol forming material with smoke from a plant material, wherein the aerosol forming material is infused with smoke treated to selectively remove therefrom one or more aromatic hydrocarbons.

* * * * *